United States Patent [19]

Stanley et al.

[11] Patent Number: 4,679,261

[45] Date of Patent: Jul. 14, 1987

[54] TELESCOPIC BED

[76] Inventors: Smith B. Stanley, c/o Haze, New York, N.Y. 10003; Yoram A. Alroy, 54 Morton St., New York, N.Y. 10014

[21] Appl. No.: 767,331

[22] Filed: Aug. 21, 1985

Related U.S. Application Data

[63] Continuation-in-part of Ser. No. 683,397, Dec. 17, 1984, abandoned.

[51] Int. Cl.[4] ..... A47C 19/04

[52] U.S. Cl. ..... 5/183; 5/181; 5/184; 5/282 R; 5/53 R; 403/104; 403/109; 403/306; 403/362; D6/505

[58] Field of Search ..... 5/181, 183, 184, 185, 5/175, 202, 282 R, 53 R; 220/235, 236; 248/172; D6/382, 505; 403/104, 109, 300, 306, 362

[56] References Cited

U.S. PATENT DOCUMENTS

| | | | |
|---|---|---|---|
| 402,129 | 4/1889 | Beckert | 5/183 |
| 611,115 | 9/1898 | Furnivall et al. | 5/183 |
| 860,938 | 7/1907 | Richards | 5/183 |
| 1,004,243 | 9/1911 | Cooper | 5/183 |
| 1,096,760 | 3/1914 | Rudolph | 5/183 |
| 1,259,022 | 3/1918 | Kean et al. | 5/183 |
| 2,960,701 | 11/1960 | Nawara | 5/181 |
| 2,973,525 | 3/1961 | Holtzclaw | 5/181 |
| 3,550,635 | 12/1970 | Schroer | 138/89 |
| 4,038,710 | 8/1977 | Tambaslio | 5/181 |
| 4,223,413 | 9/1980 | Dresher et al. | 5/282 R |
| 4,281,424 | 8/1981 | Singer et al. | 5/282 R |

FOREIGN PATENT DOCUMENTS

| | | | |
|---|---|---|---|
| 263416 | 12/1926 | United Kingdom | 5/181 |
| 648212 | 1/1951 | United Kingdom | 5/282 R |

*Primary Examiner*—Alexander Grosz
*Attorney, Agent, or Firm*—Howard C. Miskin

[57] ABSTRACT

An easily assembled bed structure adjustable in length and width comprises head and foot members each including a pair of side posts and parallel slidably telescoping multielement tubular cross pieces extending laterally between and separably joined at their ends to respective side posts, a pair of parallel, longitudinally extending side beams each including slidably telescoping tubular elements and separably coupled at their ends to respective posts and longitudinally spaced parallel stringers each including slidably telescoping tubular elements and separably coupled at their ends to opposite respective beams or a third longitudinally adjustable beam intermediate and parallel to the side beams extends between and is joined to the lowermost of the head and foot member cross pieces or bracket members project inwardly from the side beams for supporting a mattress. Foot pieces depend from the stringers or third beam. The components of the structure are secured in their assembled condition by separable fasteners.

8 Claims, 15 Drawing Figures

FIG. 6
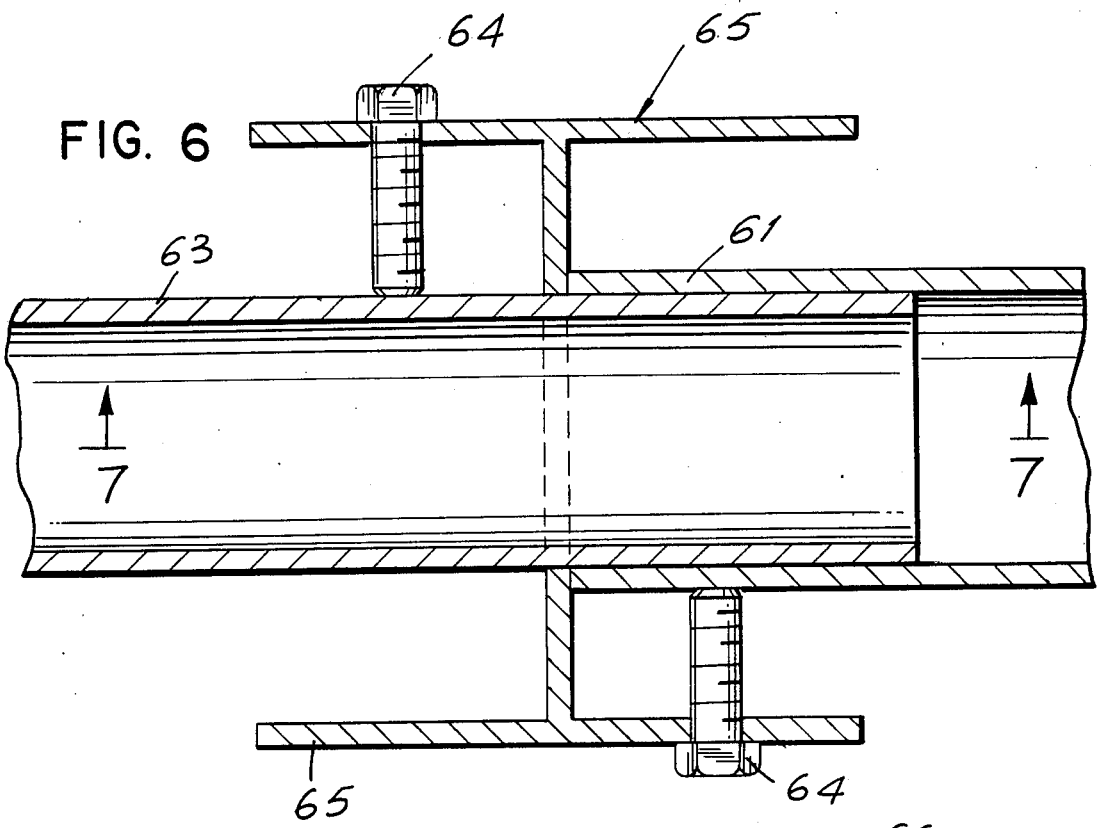
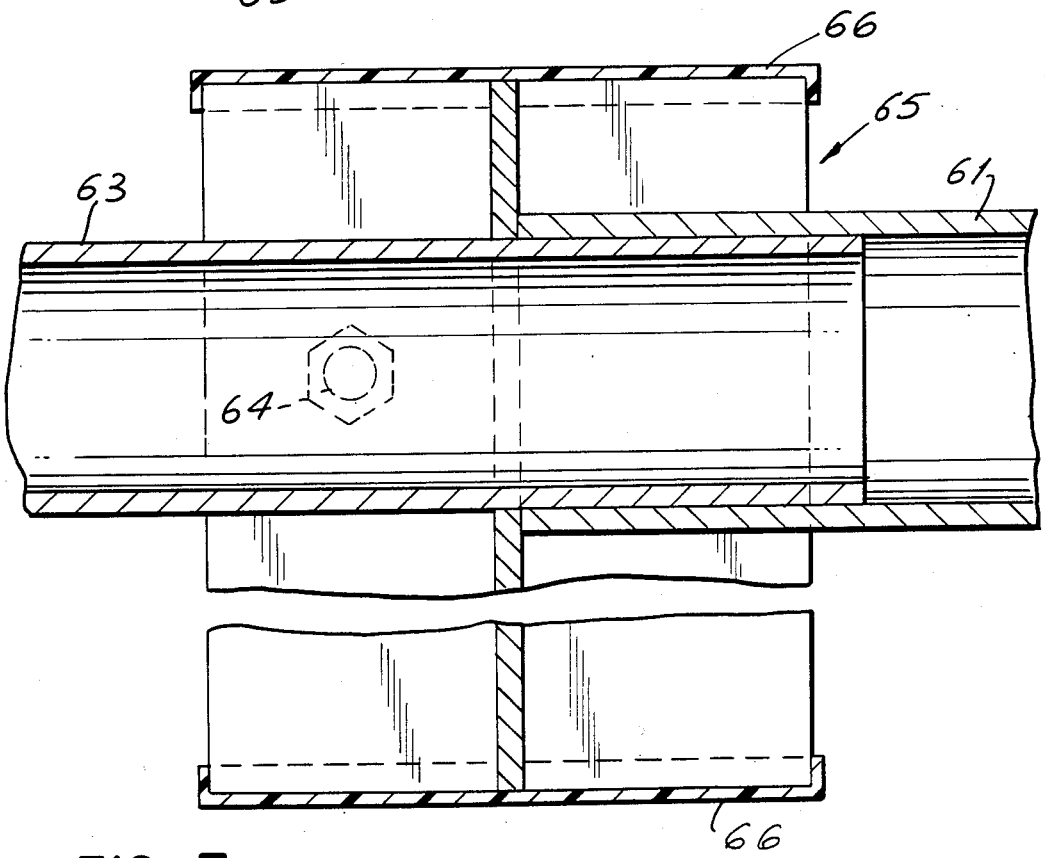
FIG. 7

TELESCOPIC BED

REFERENCE TO RELATED APPLICATION

The present application is a continuation-in-part of U.S. application serial No. 683,397, filed Dec. 17, 1984 now abandoned.

BACKGROUND OF THE INVENTION

The present invention relates generally to improvements in bed structures and it relates particularly to an improved bed structure which is adjustable in length and width and is easily assembled and disassembled.

The conventional bed generally includes head and foot boards or members, a pair of laterally spaced beams extending between and supported by the head and foot boards and a set of slats extending between and resting on the beams. These beds are of fixed predetermined sizes, crib, twin, full, queen or king and cannot be altered or adjusted in size. Moreover, the conventional bed is of expensive construction and is difficult and inconvenient to store, pack and ship, the component parts being bulky and awkward. Accordingly, to maintain a proper inventory of beds is costly and space consuming and their final cost is high for among other reasons, their high shipping costs. Collapsible beds have been heretofore available and proposed but these were likewise of fixed sizes and possessed the various drawbacks explained above and otherwise leave much to be desired.

SUMMARY OF THE INVENTION

It is accordingly a principal object of the present invention to provide an improved bed structure.

Another object of the present invention is to provide an improved bed structure of adjustable width.

Still another object of the present invention is to provide an improved bed structure of adjustable length.

A further object of the present invention is to provide an improved adjustable bed structure which may be easily and rapidly assembled with a minimum of skill and time consumption and requiring a standard screwdriver and standard box wrench as the only tools.

Still a further object of the present invention is to provide an easily assemblable adjustable bed structure which in its disassembled state is light and highly compact permitting its easy, convenient and low cost storage, packaging and shipping.

Another object of the present invention is to provide a bed structure of the above nature characterized by its ruggedness, reliability, low cost, attractive appearance and great versatility and adaptability.

The above and other objects of the present invention will become apparent from a reading of the following description taken in conjunction with the accompanying drawings which illustrate preferred embodiments thereof.

A bed structure in accordance with the present invention includes collapsible head and foot frame members of adjustable width, a pair of laterally spaced parallel side beams extending longitudinally between and separably coupled to the head and foot frame members and a plurality of longitudinally spaced parallel extendible contractible stringers extending laterally between and separably coupled to the beams or a third beam of adjustable length extending between the head and foot frame members intermediate and at the level of the side beams or brackets mounted on the side beams, such structures providing a bed frame that is adjustable in dimensions to that of a crib, single, double, queen, king, or California king, which are all the industry standards for beds.

In the preferred form of the improved bed structure each of the head and foot frame members includes a pair of laterally spaced vertical tubular posts and a plurality of vertically spaced horizontal parallel cross pieces extending laterally between and coupled to the posts, each cross piece including mutually slidably telescoping intermediate outer and side inner tubular elements and stops adjustable along the lengths of the inner elements and each of the beams including mutually slidably telescoping tubular elements which engage at their ends, laterally aligned openings in the beams. The posts, cross pieces, beams and stringers are connected by separable fastening means, preferably anchor bolts including screws and anchor nuts and where the posts or other members have exposed ends they are capped or otherwise covered. An arcuate gusset member extends between and has its opposite ends secured to the post and proximate side beam at the corner of each post and respective side beam. In an alternative structure the posts may be bent laterally inwardly at their tops to form the inner telescoping elements of the top cross pieces.

The improved collapsible bed structure is easily adjustable in length and width, is simply and rapidly assembled with the only required tools being a standard screw driver and standard box wrench, and the component parts are short and at least for the most part straight permitting their convenient compact packaging, shipping and storaging.

BRIEF DESCRIPTION OF THE DRAWINGS

FIG. 6 is an enlarged sectional view taken along line 6—6 in FIG. 1;

FIG. 7 is a fragmentary sectional view taken along line 7—7 in FIG. 6;

DESCRIPTION OF THE PREFERRED EMBODIMENT

Figures 1, 1A:
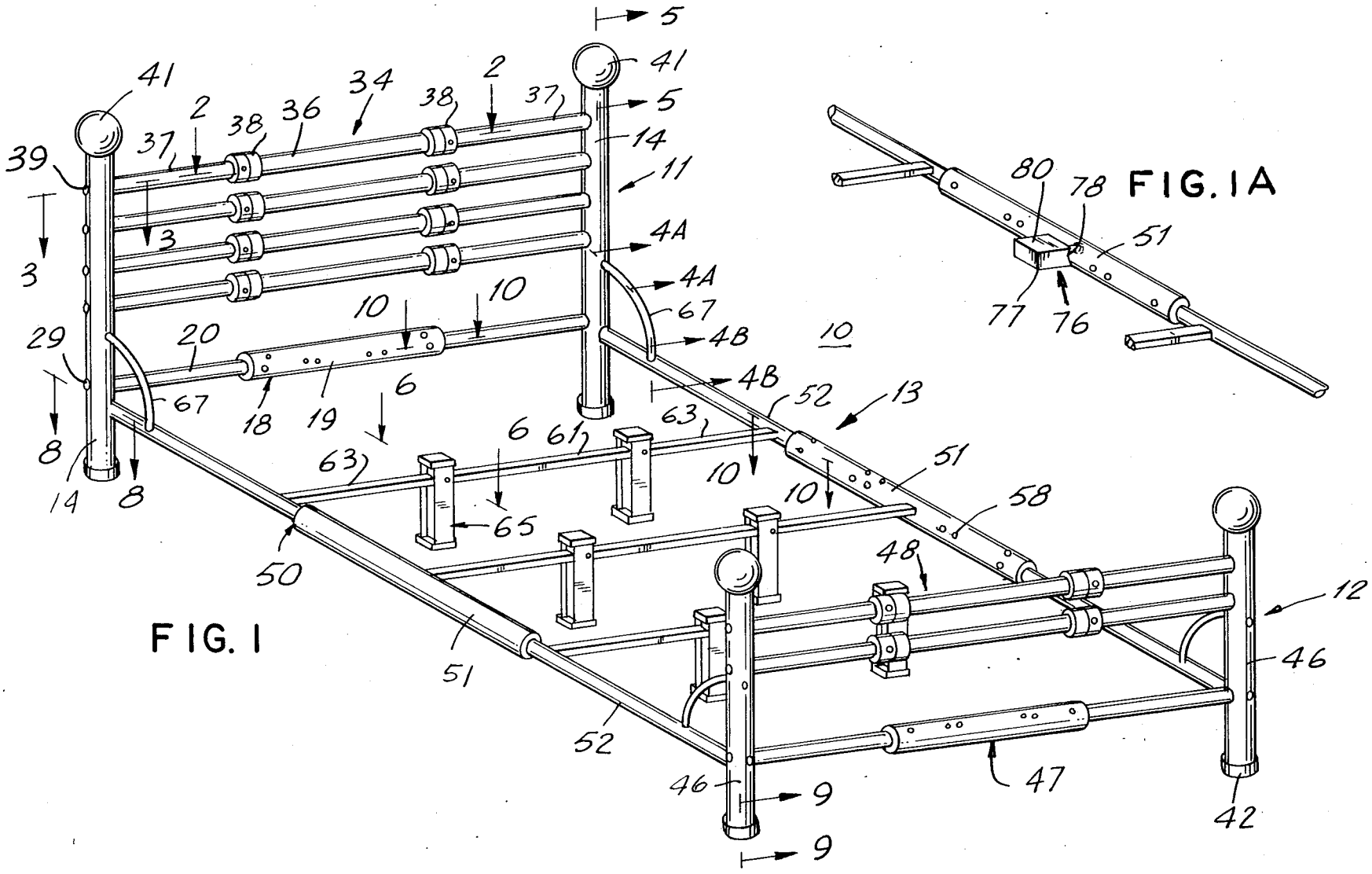
FIG. 1 is a front perspective view of a bed structure embodying the present invention.
FIG. 1A is a fragmentary perspective view of a modified portion thereof.

Referring now to the drawings, particularly FIGS. 1 to 10 thereof which illustrate a preferred embodiment of the present invention, the reference numeral 10 generally designates the improved adjustable bed which includes a head frame member 11, a foot frame member 12 and a platform frame member 13 extending between and supported by head and foot frame members 11 and 12 and having some common parts. The various major components of the bed 10, except where otherwise indicated, are formed of metal tubes, for example brass tubes or aluminum tubes, brass plated or otherwise coated, most of which are expandable and contractible to permit the adjustment of the width and length of bed 10. The structural members forming the bed 10 are separably interconnected such as by screws and anchor nuts so that the bed may be easily and rapidly assembled and disassembled and adjusted to the desired overall dimensions.

The head frame member 11 includes a pair of laterally spaced similar vertical tubular posts 14 having formed in their inner confronting peripheral walls a plurality of vertically spaced pairs of coaxial coupling openings 16. Located in the outer portions of post 14 diametrically opposite to openings 16 are coaxial openings 17 of lesser diameter than openings 16.

Extending between and engaging the lowermost pair of openings 16 is a longitudinally extendible contractible cross piece 18 which includes an intermediate tubular element 19 and a pair of opposite side or outer coaxial similar tubular elements 20 telescopically slidably engaging element 19 at opposite inside ends thereof. Tubular element 19 has formed therein a plurality of longitudinally spaced locking holes 21 and each tubular element 20 has a hole 22 formed therein similar to hole 21. A hairpin or V-shaped leaf spring 23 is housed in the inner end of each tubular element 20 and compressed between the opposing inside faces of tubular element 20 proximate holes 22. One of the legs of each leaf spring 23 is provided with a radially projecting detent 24 terminating in a rounded end and slidably engaging hole 22 and a selected axially aligned hole 21 to releasably lock tubular element 19 and respective tubular elements 20 and thus releasably lock cross piece 18 at a desired adjusted length.

The outer end of each tubular element 20 coaxially engages and projects laterally beyond a respective pair of aligned openings 16 and the outer end of each tubular element 20 is shaped to engage the inside face of the outer side wall of a respective post 14. Each post 14 is releasably fastened to the respective tubular element 20 to secure cross piece 18 to and between posts 14 by a screw 29 engaging a respective coaxial hole 17 through a washer and a tapped tube or anchor nut 30 coaxially anchored in tubular element 20 by longitudinally and peripherally spaced outwardly concave resilient anchoring wings or discs 32 having sharp or serrated peripheral edges 33 biting into the inside face of tubular element 20. The screw carried discs 32 are merely inserted into the tubular element 20 and upon tightening of screw 29 through washer and post 14 it draws and expands the discs or wings into firm biting engagement with the inside face of respective tubular element 20.

Located above cross piece 18 are a plurality of cross pieces 34 which extend horizontally between and are connected to posts 14, each cross piece 34 including an intermediate tubular element 36 slidably telescoped at each of its outer ends by a tubular elements 37. A preferably elastomeric 0-ring 35 is embraced between the confronting inside faces of elements 37 and respective ends of element 36. The cross pieces 34 are fixed at adjusted lengths by 0-rings 35 which cushion and allow for differences in dimension between and retard the relative movements of elements 36 and 37 which require manual force for such movements and are limited in their collapsible movement by decorative stops 38 adjustable along the length of each element 37. Each stop 38 includes a pair of complementary hollow shells **38*a* and 38*b* having matingly engaging inner flanges 38*c* and 38*d*. Shells 38*a* and 38*b* have coaxial inwardly extending coaxial sleeves 38*e* and 38*f* respectively slidably engaging respective element 37, the end face of sleeve 38*f* bearing axially on 0-ring 35. A set nut 38*g* engages a tapped radial bore in shell 38*a* and releasably fixes stop 38 to a desired position on each respective element 37. The 0-rings 35 may advantageously be replaced by soft compressible felt sleeves or peripherally extending strips 35' sandwiched between the confronting faces of elements 36 and 37 in the manner of the 0**-rings.

The ends of cross pieces 34 engage respective post openings 16 and are secured in position by screws 39 which engage small openings 17 in posts 14 diametrically opposite openings 16 and anchor nuts similar to anchor nuts 30 anchored in tubular elements 37. The tops of posts 14 are surmounted by finials 41 of any desired shape which overly discs closing the tops of posts 14 and are secured thereto by bolts depending from the finials and anchor nuts like 29 and 30 and the bottoms of posts 14 are closed by caps 42.

The foot frame member 12, except for being of lesser height than and having a smaller number of cross pieces above the lowermost cross piece is of similar construction to that of head frame member 11. Specifically, foot frame member 12 includes laterally spaced posts 46, lowermost cross piece 47 and upper cross piece 48 corresponding to bottom cross piece 18 and upper cross pieces 34 respectively and interconnected in the same manner.

The platform 13 includes a pair of laterally spaced parallel horizontal beams 50 extending longitudinally between and coupled to respective pairs of corresponding posts 14 and 46. Each beam 50 includes an intermediate tubular element 51 and a pair of opposite outer tubular elements 52 slidably telescoping the opposite ends of tubular element 51. The outer end portion of each tubular element 52 engages and projects through a corresponding pair of longitudinally coaxially aligned openings 53 in respective posts 14 and 46 and is secured in such coupled condition by a screw 54, and an anchor nut assembly 56 of similar construction to anchor nut 30, the screw 54 engaging a small opening in post 14 coaxial with a respective opening 53 and a respective anchor nut 56 in the manner of the securing of cross pieces 34. Tubular element 51 is provided at its end portions with longitudinally spaced openings 58 and a hairpin leaf spring biased detent corresponding in construction and relationship to detent 24 axially slidably engages an opening in the inner end portion of each tubular element 52 and releasably engages a respective opening 58 to permit the adjustment of the length of each beam 50.

Formed in each beam tubular element 51 intermediate its ends and in each beam tubular element 52, between its ends, in their laterally inwardly facing portions, are rectangular coupling openings which are laterally coaxially aligned with corresponding opening in the opposite beam 50.

A plurality of parallel stringers or slats extend laterally between and are supported by beams 50 and each stringer includes an intermediate rectangular tubular element 61 whose opposite ends are slidably telescopically engaged by outer rectangular tubular elements 63. A pair of laterally spaced posts or foot pieces 65 of H-shaped transverse cross section is provided with each having a rectangular opening in its cross web slidably engaging a respective element 63, the cross web abutting a respective end face of intermediate element 61. A set screw 64 engages a tapped bore in each side arm of post 65 and bears respectively on an element 63 and an element 61 to releasably lock them in a preadjusted position. The top and bottom of each foot piece 65 is covered by a shallow rectangular cap 66 including a horizontal end face and a peripheral skirt walls. The end walls of bottom caps 66 lie in a common plane with the bottoms of posts 14 and 46 and the end walls of top caps 66 lie in a common horizontal plane with the top of frame 13. It should be noted that while the stringers and their component elements 61 and 63 and the various openings engaged thereby are illustrated as being of rectangular cross-sections and shapes they may be circular instead and rotation of the stringers 60 about their axes may be prevented by vertical bolts in the respective elements of beams 50 engaging vertically opposed slots in the free ends of round elements 63.

The upper corners between head and foot frames 11 and 12 and platform frame 13 are reinforced by gusset members 76. Each gusset member 76 is tubular and includes a 90 degree arcuate section 67 terminating at its opposite ends in straight sections 68 and 69. Each gusset straight section 67 projects through an opening 70 in a respective post 14 or 46 into mating engagement with the opposite inside face of the post and is secured to the post by a screw 71 extending through a bore in the post coaxial with a gusset section 68 and engaging an anchor nut 72 anchored to the inside face of a gusset section 68 in the manner earlier described. Similarly, a gusset section 69 extends through an opening in beam section 52 into engagement with the opposite inside face of a respective beam section 52 and is releasably secured by a screw 73 and an anchor nut 74 as above explained.

In the disassembled condition of bed 10 the gusset members 76 are separated from the posts 14 and 46 and beam sections 52 and the posts are separated from cross pieces 18 and 34 and 47 and 48 respectively which are fully contracted along their lengths to highly compact conditions. Foot pieces 65 are separate from stringers 61 which are separate from beams 50, the stringers and beams being longitudinally fully contracted to highly compact conditions. The separate fully contracted bed components can be very compactly bunched and packaged together with the various fastening and locking devices, the resulting package requiring a minimum of packaging material, resulting in an inexpensively packaged disassembled bed which is light weight, easy to handle and store, and inexpensive to ship.

The bed is easily and rapidly assembled from its component parts, requiring only the use of a standard screwdriver and standard box wrench and a minimum of skill. The cross pieces, stringers and beams are extended, and locked to their desired lengths by the associated locking devices, the foot pieces applied to the stringers and the stringers coupled at their ends with the coupling openings in the beams, the stringers being locked to their adjusted lengths by tightening the foot piece carrying set screws. The cross pieces are coupled with the coupling openings in the posts and the cross pieces are locked in assembled condition with the posts by means of the screws and anchor nuts. The ends of the beams are then coupled with the longitudinally aligned openings in the posts, fastened by screws and anchor nuts and the reinforcing gussets 76 are applied and secured by the screws and anchor nuts. Finials are then applied to the tops of the posts to finish the assembly. The width of the assembled bed depends on the lengths of the stringers and cross pieces which are adjustable and the length of the bed depends on the adjusted lengths of the beams. The resulting bed is rugged, light weight and of highly attractive appearance, is easily adjustable in size and easily disassembled and packaged.

In FIG. 1A there is shown a modification of the bed structure described above in which the intermediate stringer and the foot pieces 65 carried thereby are omitted and replaced by a pair of brackets 76. Each bracket 76 includes a block 77 having a concave cylindrical end face 78 engaging the inner face of a respective beam intermediate element 51 intermediate the ends thereof. The block 77 is secured to respective beam element 51 by a bolt engaging coaxial radial bores in beam element 51 and a tapped bore in block 77. The top faces 80 of blocks 77 are coplanar with the top faces of foot piece upper caps 66. In all other respects the bed having the structure shown in FIG. 2A is similar to the bed 10.

Figure 2:
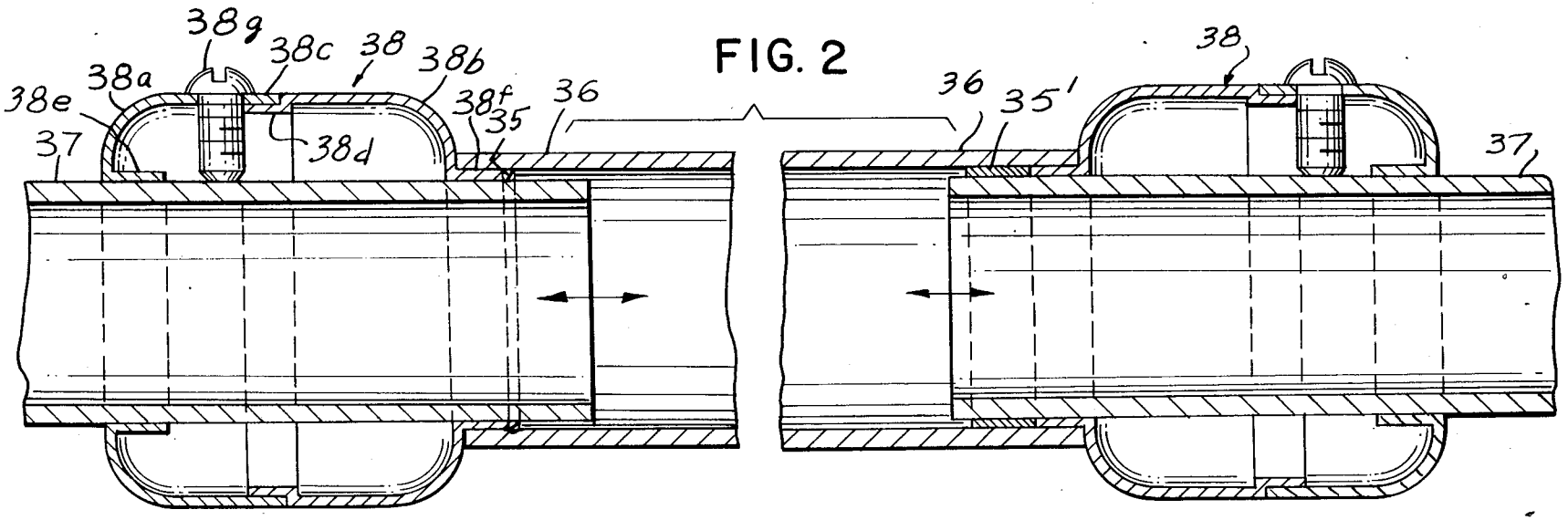
FIG. 2 is a fragmentary enlarged sectional view taken along line 2—2 of FIG. 1.
Figure 2A:
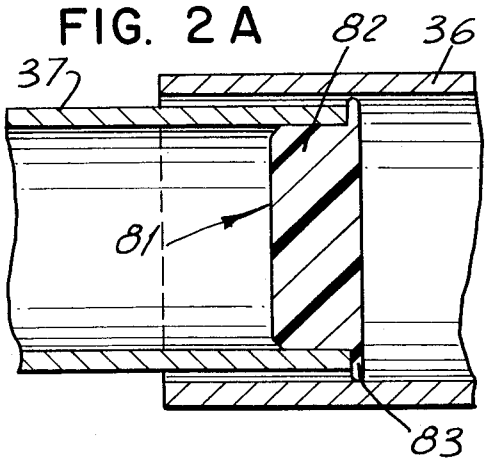
FIG. 2A is a fragmentary view of a part of the structure shown in FIG. 2 showing a modification thereof.
Figure 3:
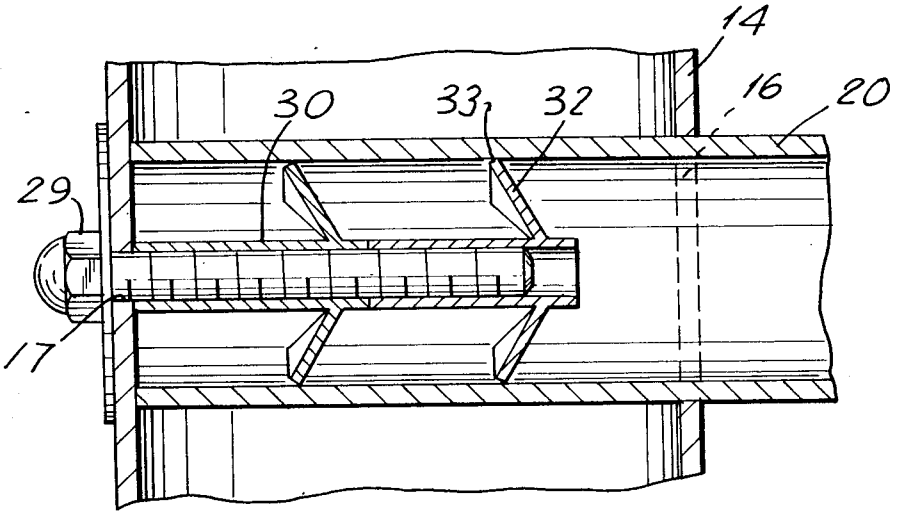
FIG. 3 is a fragmentary enlarged sectional view taken along line 3—3 in FIG. 1.
Figure 4B:
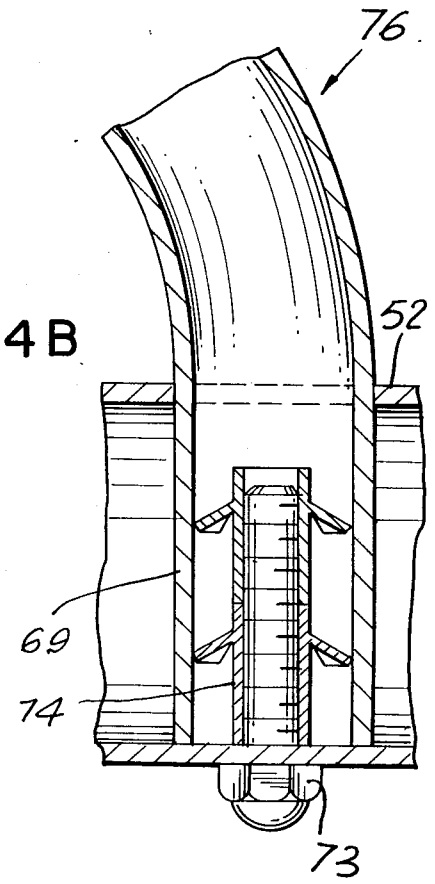
FIG. 4B is an enlarged sectional view taken along line 4B—4B in FIG. 1.
Figure 4A:
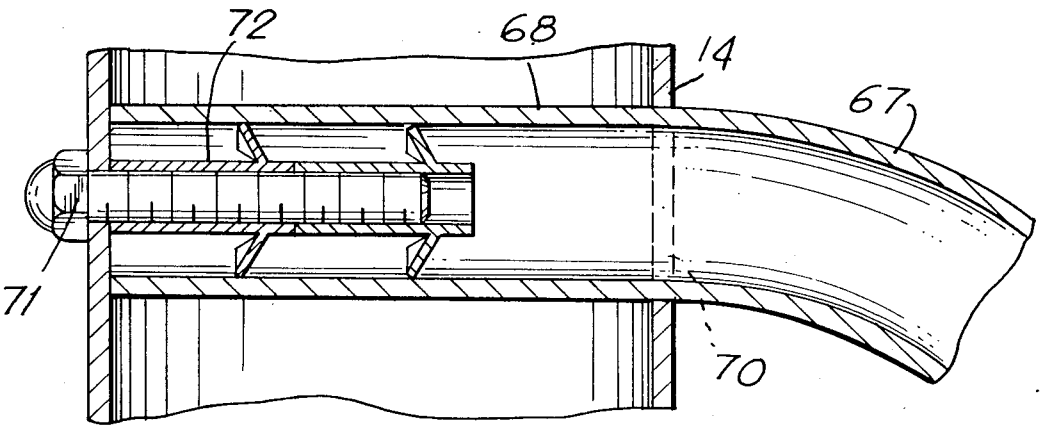
FIG. 4A is an enlarged sectional view taken along line 4A—4A in FIG. 1.
Figure 5:
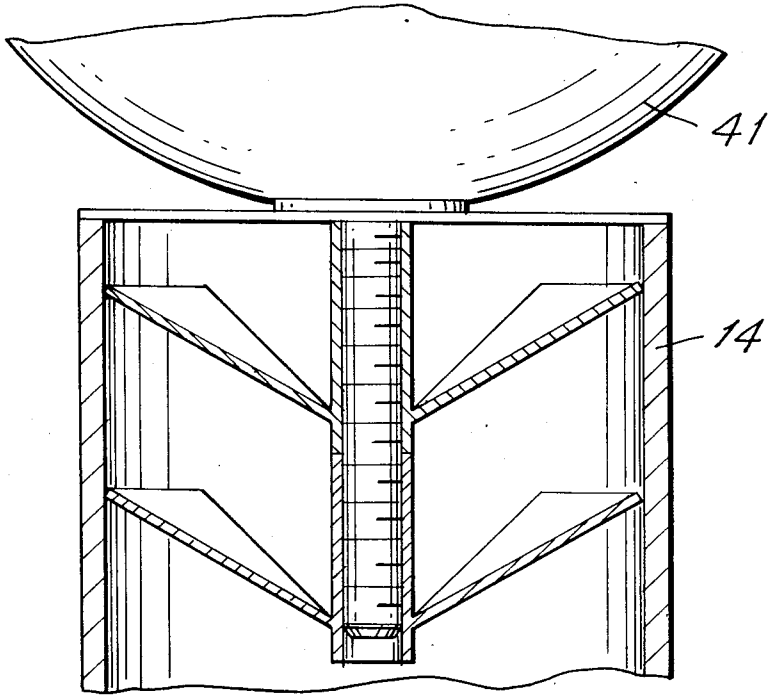
FIG. 5 is an enlarged sectional view taken along line 5—5 in FIG. 1.
Figure 9:
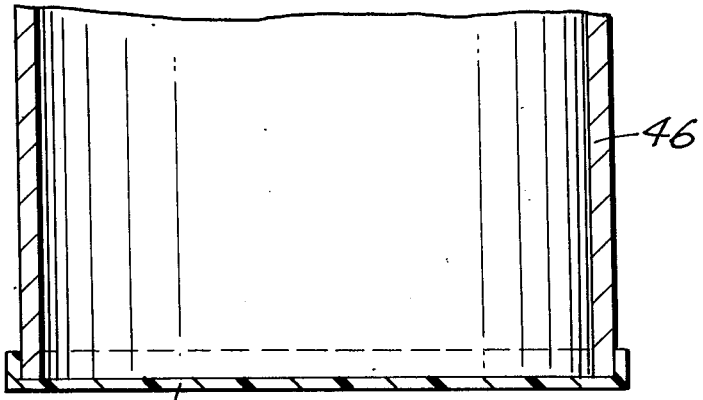
FIG. 9 is an enlarged sectional view taken along line 9—9 in FIG. 1.
Figure 8:
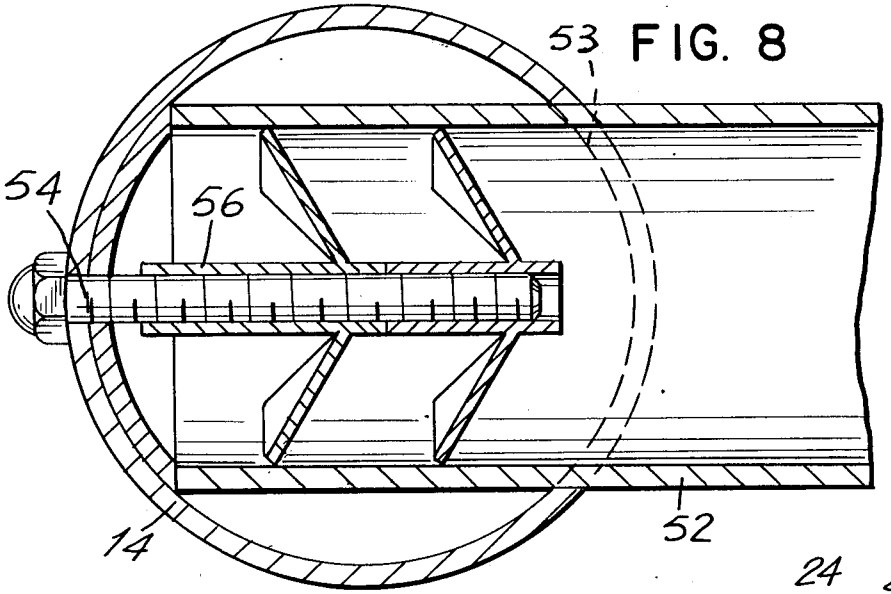
FIG. 8 is an enlarged sectional view taken along line 8—8 in FIG. 1.
Figure 10:
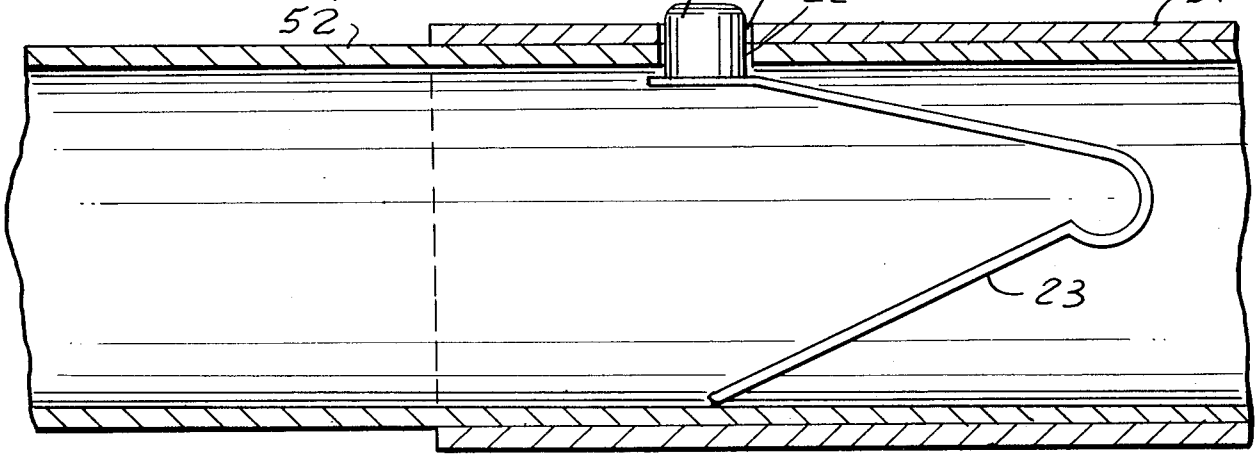
FIG. 10 is an enlarged sectional view taken along line 10—10 in FIG. 1.

A further modification of the bed 10 is shown in FIG. 2A of the drawings in which the 0-ring 35 is replaced by a flanged plug 81. Specifically, 0-rings 35 are omitted and in their place are employed plugs 81 each of which is formed of a resilient or elastomeric material and includes a cylindrical body member 82 having a bevelled peripheral edge and being in tight telescoping engagement with the inner end portion of a cross piece tubular outer element 37. A peripheral flange 83 is formed at the outer end of body member 82 and abuts the end face of element 37. The flange 83 projects radially beyond the outside face of element 37 into engagement with the proximate inside face of intermediate tubular element 36 and serves the function of replaced 0-ring 35.

Figure 11:
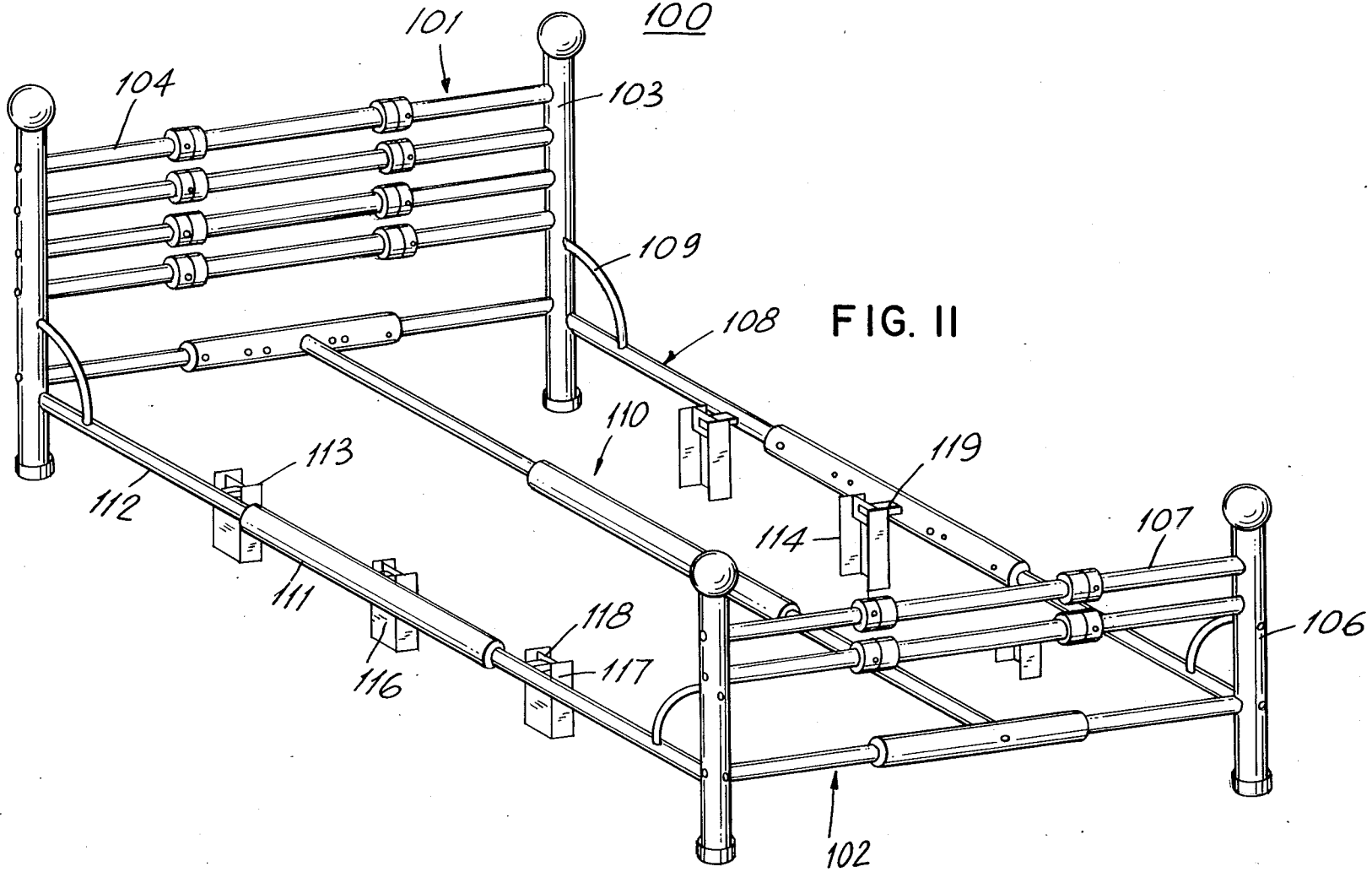
FIG. 11 is a front perspective view of another embodiment of the present invention.

Referring now to FIG. 11 of the drawings which illustrates another embodiment of the present invention in which the improved bed 100 includes head and foot frames 101 and 102 respectively, each being of adjustable width and similar in structure to head and foot frames 11 and 12 respectively. Head frame 101 includes vertical posts 103 and vertically spaced length adjustable cross pieces and foot frame 102 includes vertical posts 106 and vertically spaced length adjustable cross pieces 107. Extending between and coupled to respective pairs of posts 103 and 106 in the manner earlier described and at the lower portions thereof are horizontal parallel beams 108 of adjustable lengths, the posts and beams being reinforced at their corners by arcuate gusset members 109. Extending between and suitably coupled at its ends to the intermediate portions of the intermediate tubular elements of lowermost cross pieces 104 and 107 is a beam 110 which is parallel, coplanar and intermediate beams 108 and of a structure similar thereto.

Attached to and depending from each intermediate and end tubular section 111 and 112 respectively of each side beam 108 is a foot piece 113. Each foot piece 113 includes a channel shaped post 114 having an outer cross web 116 cut away at its upper part, side legs 117 and a vertical cross web 118 extending between the upper parts of side legs 117. A short connecting arm 119 extends between and is suitably secured at its ends to each post 114 and a respective beam section 111 or 112. The bottoms of posts 103, 106, and 114 lie in a common horizontal plane and the tops of posts 114 lie in a common horizontal plane, the tops of posts 114 preferably being suitably capped.

Figure 12:
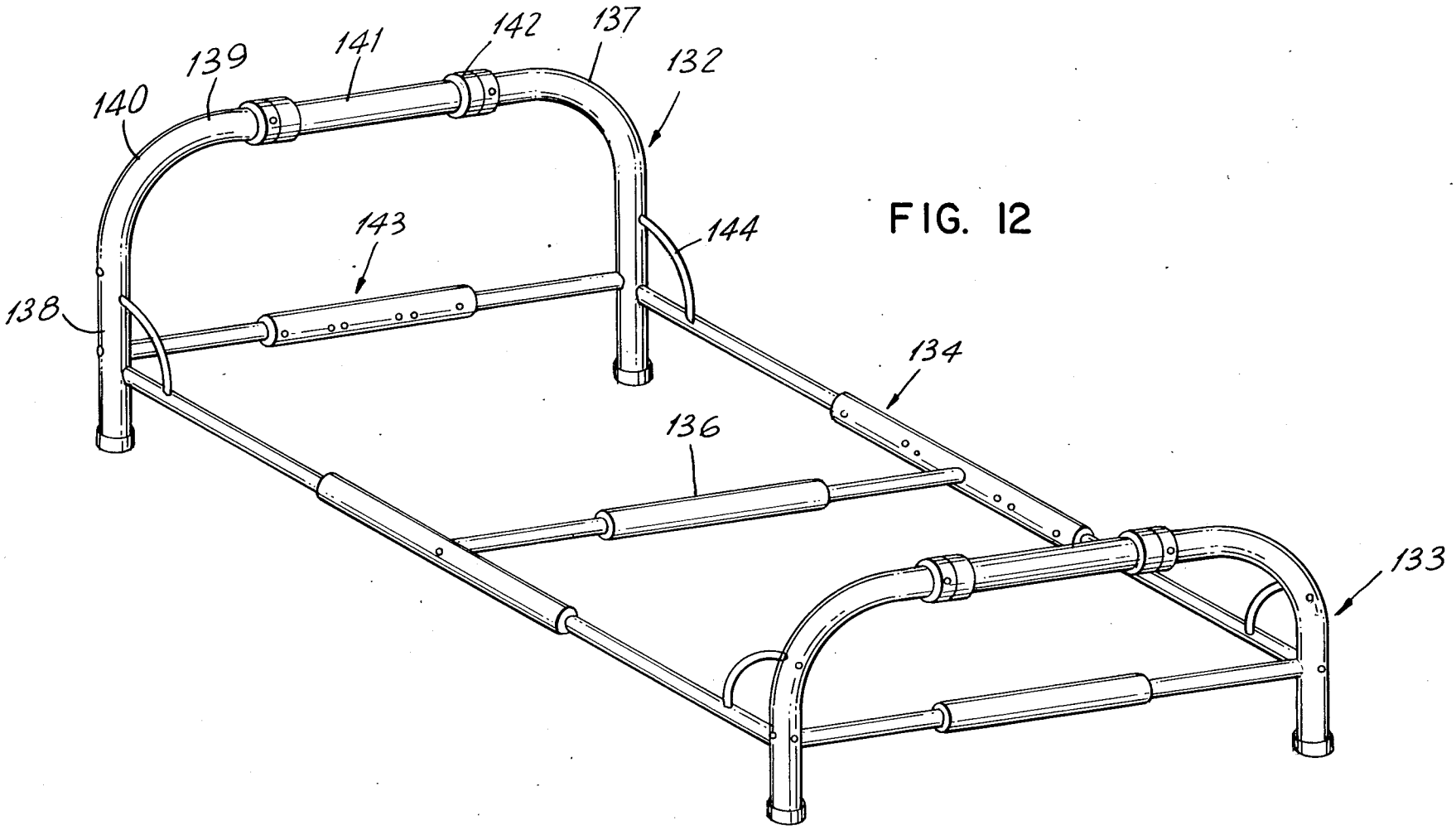
FIG. 12 is a front perspective view of a further embodiment of the present invention.

A bed 130 constituting a further embodiment of the present invention is illustrated in FIG. 12 of the drawings, and includes adjustable width head and foot frames 132 and 133 respectively, parallel horizontal side beams 134 of adjustable lengths extending between and separably secured to the head and foot frames and a plurality of longitudinally spaced parallel stringers 136 (only one being shown) of adjustable lengths extending laterally between beams 134. Head frame 132 comprises a pair of laterally spaced similar side members 137 each including a vertical tubular post 138 and an upper horizontal linear inwardly extending tubular leg 139 joined by an integrally formed arcuate tubular elbow section 140. The legs 139 are coaxial and slidably telescope an intermediate cross piece section 141, stop members 142 being adjustably mounted along legs 139. Legs 139, section 141 and stops 142 correspond to cross piece sections 37, and 36 and stops 38 earlier described and are similarly related. A lower cross piece 143 of adjustable length extends between and is separably secured at its ends to the lower portions of posts 138 in the manner of cross piece 18 and is similarly constructed.

Foot frame 133, except for being of lesser height, is similar in construction to head frame 132. Beams 134 are similar in construction and their relationship to the head and foot frame vertical posts to beams 50 and stringers 136 are similar in construction to cross piece 143. The corners between beams 134 and the head and foot frame posts are reinforced by arcuate gusset members 144 constructed, secured and functioning in the manner of gusset members 76.

While there have been described and illustrated preferred embodiments of the present invention, numerous alterations, omissions and additions may be made without departing from the spirit thereof.

We claim:

1. A bed structure comprising:

a rear vertical head frame member of adjustable width including a pair of laterally spaced vertical tubular first posts and vertically spaced first cross pieces of adjustable lengths, each of said cross pieces above the lowermost cross piece including an intermediate tubular section and a pair of outer tubular sections telescoping opposite ends of said intermediate section and a soft compressible peripherally extending cushion member sandwiched between the confronting peripheral faces of said outer tubular sections and said intermediate section, and separable fastening means securing the opposite ends of said head frame cross pieces to respective head frame posts;

a front vertical foot frame member of adjustable width including a pair of laterally spaced vertical tubular second posts and vertically spaced second cross pieces of adjustable lengths each of said second cross pieces above the lowermost second cross piece including an intermediate tubular section and a pair of outer tubular sections telescoping opposite ends of said tubular section and soft compressible peripherally extending cushion member sandwiched between the confronting peripheral faces of said second cross piece outer tubular sections and the intermediate tubular section, and separable fastening means securing the opposite ends of said second cross pieces to respective second posts;

a pair of laterally spaced longitudinally extending parallel horizontal side beams of adjustable lengths extending between respective first posts and respective second posts substantially at the level of the lowermost cross pieces of said head and foot frame members and defining therewith a bottom frame and separable fastening means securing the opposite ends of said beams to respective pairs of said first and second posts;

mattress support means carried by said bottom frame and including longitudinally spaced parallel horizontal stringers of adjustable lengths extending between said beams; and a gusset member located proximate the corner of the end portion of each beam and the portion of the post connected to and projecting above the respective beam and separable fastening means securing said gusset member at their ends to respective posts and beams at points spaced from said corners.

2. The bed structure of claim 1 wherein each of said separable fastening means includes a self-anchoring nut and a screw engaging said nut.

3. The bed structure of claim 1 wherein each of said stringers includes an intermediate tubular section and a pair of tubular outer sections slidably telescoping opposite ends of said intermediate tubular section.

4. The bed structure of claim 3 including foot pieces depending from said stringers and terminating at their bottoms at the level of the bottoms of said head and foot frame posts.

5. The bed structure of claim 1 including means for releasably locking the lowermost of said head and foot frame cross pieces in preadjusted extending positions.

6. The bed structure of claim 1 wherein said mattress support means includes bracket members secured to and projecting inwardly from each of said beams.

7. The bed structure of claim 1 wherein said vertical first posts integrally formed with and joined to the uppermost tubular outer sections by curved intermediate sections.

8. A bed structure comprising:

a rear vertical head frame member of adjustable width including a pair of laterally spaced vertical tubular first posts and vertically spaced first cross pieces of adjustable lengths, each of said cross pieces above the lowermost cross piece including a plurality of mutually telescoping tubular sections and a soft compressible peripherally extending cushion member sandwiched between the confronting faces of said mutually telescoping tubular sections and separable fastening means securing the opposite ends of said head frame cross pieces to respective head frame posts;

a front vertical foot frame member of adjustable width including a pair of laterally spaced vertical tubular second posts and vertically spaced second cross pieces of adjustable lengths each of said second cross pieces above the lowermost cross piece including a plurality of mutually telescoping tubular sections and a soft compressible peripherally extending cushion member sandwiched between the confronting faces of said second cross piece mutually telescoping tubular sections, and separable fastening means securing the opposite ends of said second cross pieces to respective second posts;

a pair of laterally spaced longitudinally extending parallel horizontal side beams of adjustable lengths extending between respective first posts and respective second posts substantially at the level of the lowermost cross pieces of said head and foot frame members and defining therewith a bottom frame and separable fastening means securing the opposite ends of said beams to respective pairs of said first and second posts;

mattress support means carried by said bottom frame and including longitudinally spaced parallel horizontal stringers of adjustable lengths extending between said beams; and a gusset member located proximate the corner of the end portion of each beam and the position of the post connected to and projecting above the respective beam and separable fastening means securing said gusset member at their ends to respective posts and beams at points spaced from said corners.

* * * * *